US009535391B2

(12) United States Patent
Yokoi

(10) Patent No.: US 9,535,391 B2
(45) Date of Patent: Jan. 3, 2017

(54) IMAGE FORMING APPARATUS HAVING DETACHABLE DEVELOPING CARTRIDGE

(71) Applicant: BROTHER KOGYO KABUSHIKI KAISHA, Nagoya-shi, Aichi-ken (JP)

(72) Inventor: Junichi Yokoi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 141 days.

(21) Appl. No.: 14/664,461

(22) Filed: Mar. 20, 2015

(65) Prior Publication Data

US 2015/0277345 A1 Oct. 1, 2015

(30) Foreign Application Priority Data

Mar. 31, 2014 (JP) ..... 2014-071744

(51) Int. Cl.
*G03G 21/12* (2006.01)
*G03G 21/16* (2006.01)

(52) U.S. Cl.
CPC ..... *G03G 21/12* (2013.01); *G03G 21/1609* (2013.01)

(58) Field of Classification Search
CPC ..... G03G 2221/1869; G03G 21/12; G03G 21/169
USPC ..... 399/110, 113, 120, 122, 123
See application file for complete search history.

(56) References Cited

U.S. PATENT DOCUMENTS 4,849,791 A * 7/1989 Hagihara ..... G03G 21/12 399/360
5,581,342 A * 12/1996 Yamauchi ..... G03G 21/12 399/123
5,749,027 A * 5/1998 Ikemoto ..... G03G 21/181 399/111
8,538,290 B2 * 9/2013 Okamoto ..... G03G 21/1842 399/110
2009/0052940 A1 2/2009 Mizuno et al.
2010/0247140 A1 * 9/2010 Kikuchi ..... G03G 21/12 399/111
2015/0277368 A1 * 10/2015 Nishiyama ..... G03G 15/0865 399/111

FOREIGN PATENT DOCUMENTS

JP S62-50844 A 3/1987
JP S64-15758 A 1/1989
JP 2009-048138 A 3/2009
JP 2014-016484 A 1/2014

* cited by examiner

*Primary Examiner* — Francis Gray
(74) *Attorney, Agent, or Firm* — Merchant & Gould P.C.

(57) ABSTRACT

An image forming apparatus is provided with: an apparatus body; a photosensitive member; a developing cartridge configured to have a developer supporting body; a cleaner configured to collect developer remaining on the photosensitive member; and a waste developer container configured to contain developer collected by the cleaner. The apparatus body is configured to have an installment passage, through which the developing cartridge passes when the developing cartridge is installed into and removed from the apparatus body. The waste developer container is configured to be movable between a first position at which at least a part of the waste developer container is located within the installment passage and a second position at which the waste developer container is located away from the installment passage.

19 Claims, 16 Drawing Sheets

IMAGE FORMING APPARATUS HAVING DETACHABLE DEVELOPING CARTRIDGE

CROSS-REFERENCE TO RELATED APPLICATION

This application claims priorities from Japanese Patent Application No. 2014-071744 filed on Mar. 31, 2014, the entire subject matter of which is incorporated herein by reference.

TECHNICAL FIELD

The present disclosure relates to an image forming apparatus having a photosensitive member, a developing cartridge that is detachable from an apparatus body, and a waste developer container for containing developer that is collected from the photosensitive member.

BACKGROUND

An image forming apparatus is known which has a developing cartridge that is detachable from an apparatus body through an opening provided at a top of an apparatus body and a photosensitive member that is arranged above the developing cartridge. An example of such apparatus is shown in JP-A-2014-016484.

In the image forming apparatus disclosed in JP-A-2014-016484, in a case where the a photosensitive member cartridge is provided with a waste developer container for containing developer that is collected from the photosensitive member, it is unavoidable to arrange the waste developer container in a space above the developing cartridge because there is no much space to install the waste developer container in the apparatus.

However, when the image forming apparatus is configured to have the waste developer container arranged above the developing cartridge, the waste developer container may interfere with the developing cartridge when attaching or detaching the developing cartridge to or from the apparatus body through an opening.

SUMMARY

The present disclosure has been made in view of the above circumstances, and one of objects of the present disclosure is to provide an image forming apparatus that is equipped with a waste developer container and a developing cartridge that is easily detachable from the apparatus body.

According to an illustrative embodiment of the present disclosure, there is provided an image forming apparatus including: an apparatus body; a photosensitive member; a developing cartridge configured to have a developer supporting body; a cleaner configured to collect developer remaining on the photosensitive member; and a waste developer container configured to contain developer collected by the cleaner. The apparatus body is configured to have an installment passage, through which the developing cartridge passes when the developing cartridge is installed into and removed from the apparatus body. The waste developer container is configured to be movable between a first position at which at least a part of the waste developer container is located within the installment passage and a second position at which the waste developer container is located away from the installment passage.

According to another illustrative embodiment of the present disclosure, there is provided an image forming apparatus including: an apparatus body; a developing cartridge including a development roller; and a drum cartridge including: a photosensitive drum; a cleaner configured to collect developer remaining on the photosensitive drum; and a waste developer container configured to contain developer collected by the cleaner. The apparatus body comprises a guide configured to guide the developing cartridge. The waste developer container is configured to be movable between a first position and a second position in a state where the drum cartridge is installed in the apparatus body, the waste developer container being located more away from the guide the second position than at a the first position.

BRIEF DESCRIPTION OF THE DRAWINGS

In the accompanying drawings:

FIGS. 4A and 4B show the laser printer of FIG. 1 whose top cover is opened, wherein FIG. 4A illustrates how a first twisted coil spring works, and wherein FIG. 4B is an enlarge view of a photosensitive drum shaft shown in FIG. 4A and its neighborhood;

FIGS. 5A and 5B are enlarged views of the photosensitive member cartridge, the developing cartridge, and their neighborhoods, wherein FIG. 5A shows a state that a development roller and a photosensitive drum are in contact with each other, and wherein FIG. 5B shows a state that the development roller and the photosensitive drum are separated from each other;

DETAILED DESCRIPTION

[First Embodiment]

A first embodiment of the present disclosure will be hereinafter described in detail while reference is made to the drawings. The overall configuration of a laser printer 1 which is an example image forming apparatus of the present disclosure will be described first, and thereafter, details of the present disclosure will be described.

The following description will be made with the directions defined with respect to a user who uses the laser printer 1. More specifically, in FIG. 1, the "front side" and the "rear side" are defined as the left side and the right side of the paper surface, respectively. The "left side" and the "right side" are defined as the deep side and the viewer's side of the paper surface, respectively. And the "top-bottom direction" is defined as the top-bottom direction in the paper surface.

<General Configuration of Laser Printer>

Figure 1:
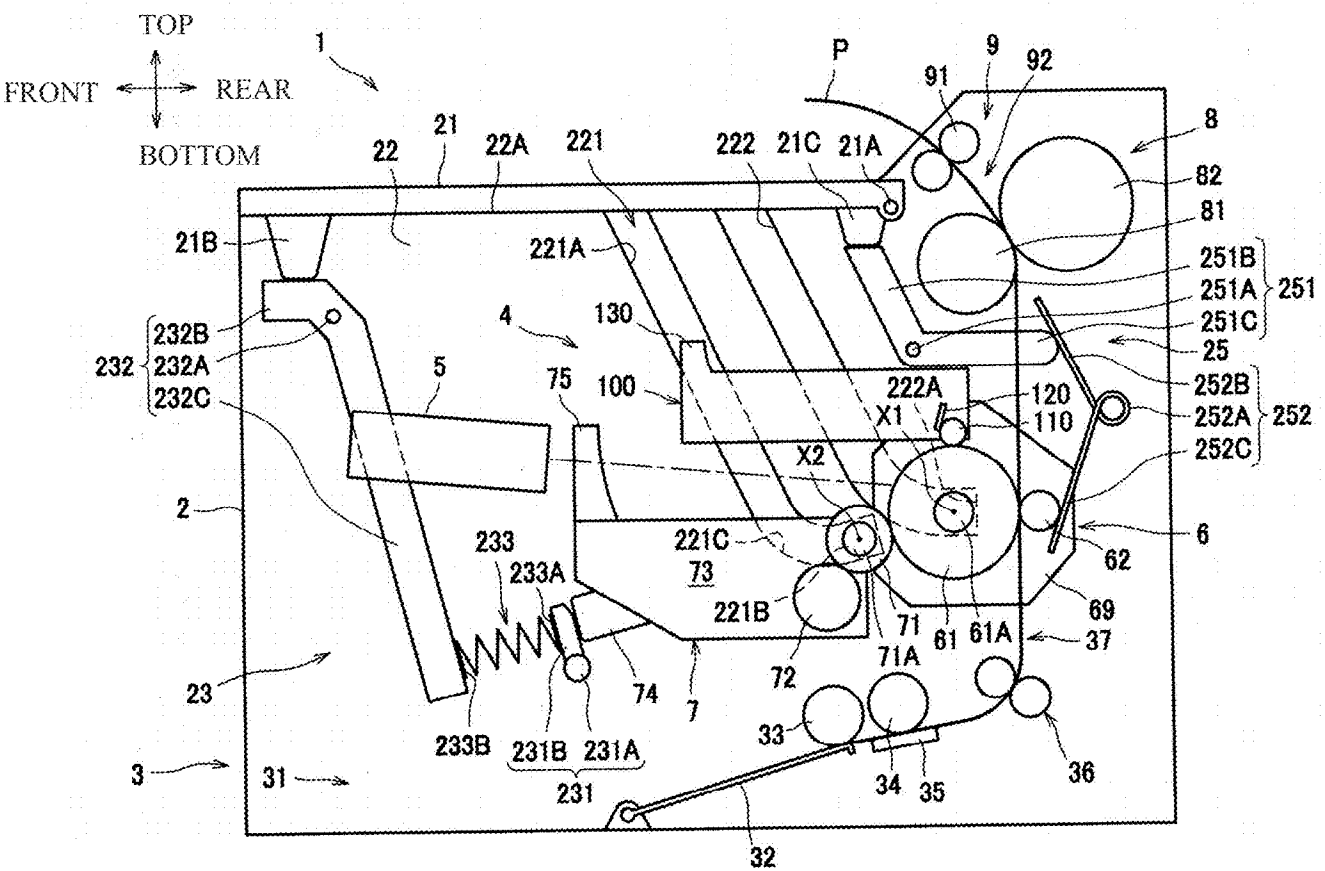
FIG. 1 shows a general configuration of a laser printer according to a first embodiment of the present disclosure.

As shown in FIG. 1, in the laser printer 1, a feed unit 3, an image forming unit 4, and a discharge unit 9 are provided inside an apparatus body 2.

Figure 2:
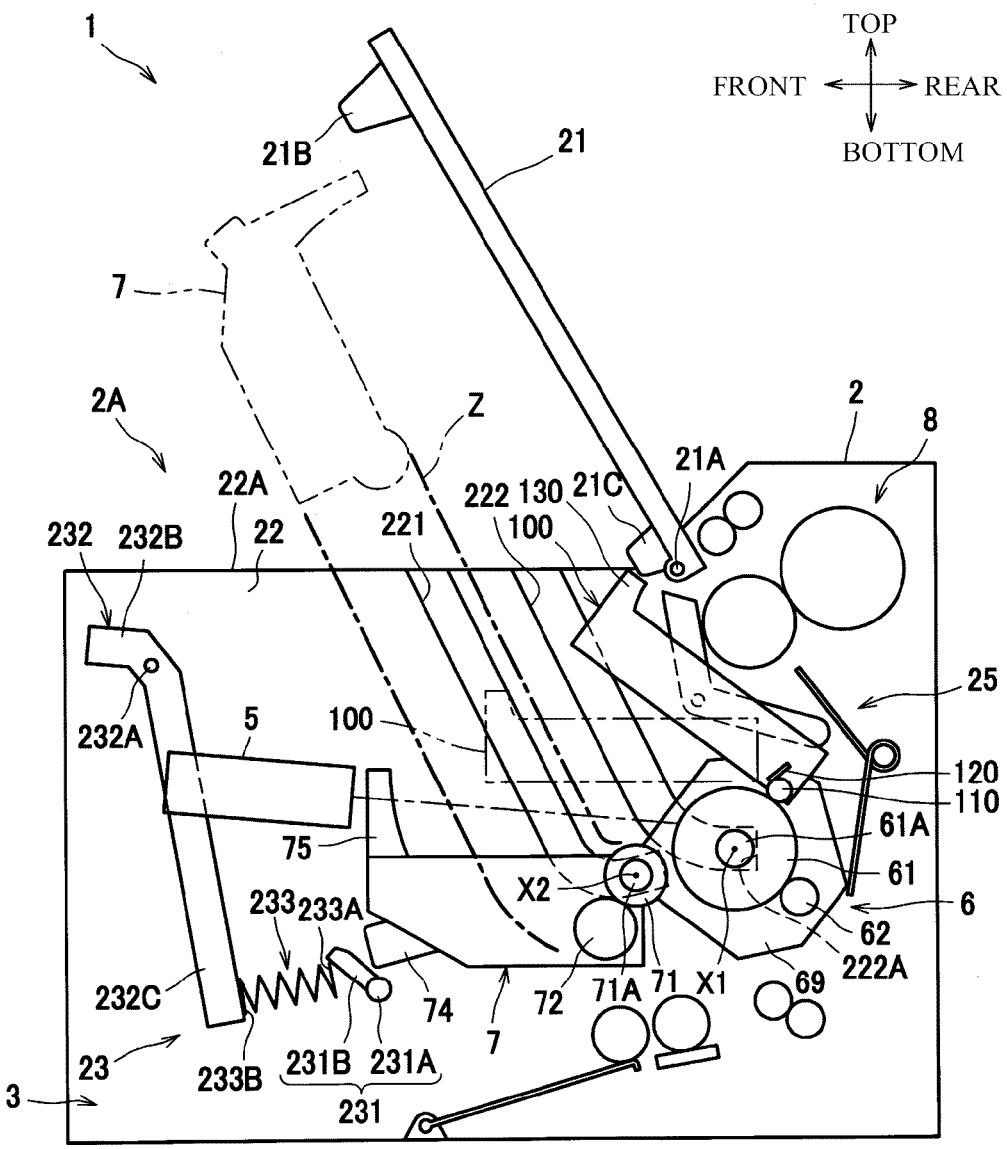
FIG. 2 shows the laser printer of FIG. 1 in which a top cover is opened and a photosensitive member cartridge is swung upward.

As shown in FIG. 2, a top opening 2A is formed at the top of the apparatus body 2 (above a waste toner container 100 (described later)). The apparatus body 2 is equipped with a top cover 21 which is an example of a cover that covers the opening 2A from above. The top cover 21 is provided so as to be rotatable about a rotation shaft 21A that is attached to the apparatus body 2 at a top position and hence to open or close the opening 2A. The top cover 21 has a first projection 21B which projects from a front end portion of the bottom surface of its body and a second projection 21C which projects from a rear end portion of the bottom surface of its body.

The feed unit 3, which serves to feed a sheet P (an example of a recording sheet) to the image forming unit 4, is arranged in a bottom space of the apparatus body 2 (below the waste toner container 100). The feed unit 3 is provided with a sheet feed tray 31, a sheet pressing plate 32, a pickup roller 33, a separation roller 34, a separation pad 35, a conveying roller pair 36, and a conveying path 37 which is an example of a first conveying path.

The conveying path 37, which is a path for conveying a sheet P supplied from the sheet feed tray 31 toward the position between a photosensitive drum 61 and a transfer roller 62, extends rearward from around the pickup roller 33, is thereafter curved upward around the conveying roller pair 36, and then extends toward the position between the photosensitive drum 61 and the transfer roller 62.

Sheets P placed on the sheet feed tray 31 are brought into contact with the pickup roller 33 by the sheet pressing plate 32 and picked up by the pickup roller 33 and then separated into the individual sheet by the separation roller 34 and the separation pad 35. The topmost sheet P is curved upward at a rear position in the apparatus body 2 (on a first side (one side) in the horizontal direction) and then conveyed toward the image forming unit 4 (i.e., photosensitive drum 61 (described later)) by the conveying roller pair 36.

The image forming unit 4, which serves to form an image on a sheet P supplied to it, is arranged above the sheet feed tray 31 and is equipped with an exposing unit 5, a photosensitive member cartridge 6, a developing cartridge 7, and a fixing unit 8.

The exposing unit 5 is arranged at a front position and at a central position in the top-bottom direction inside the apparatus body 2, and equipped with a laser light-emitting unit, a polygon mirror, a lens, a reflector, etc. (none of which are shown). The exposing unit 5 scans the surface of the photosensitive drum 61 (an example of a photosensitive member) with a laser beam at a high speed.

Figure 7:
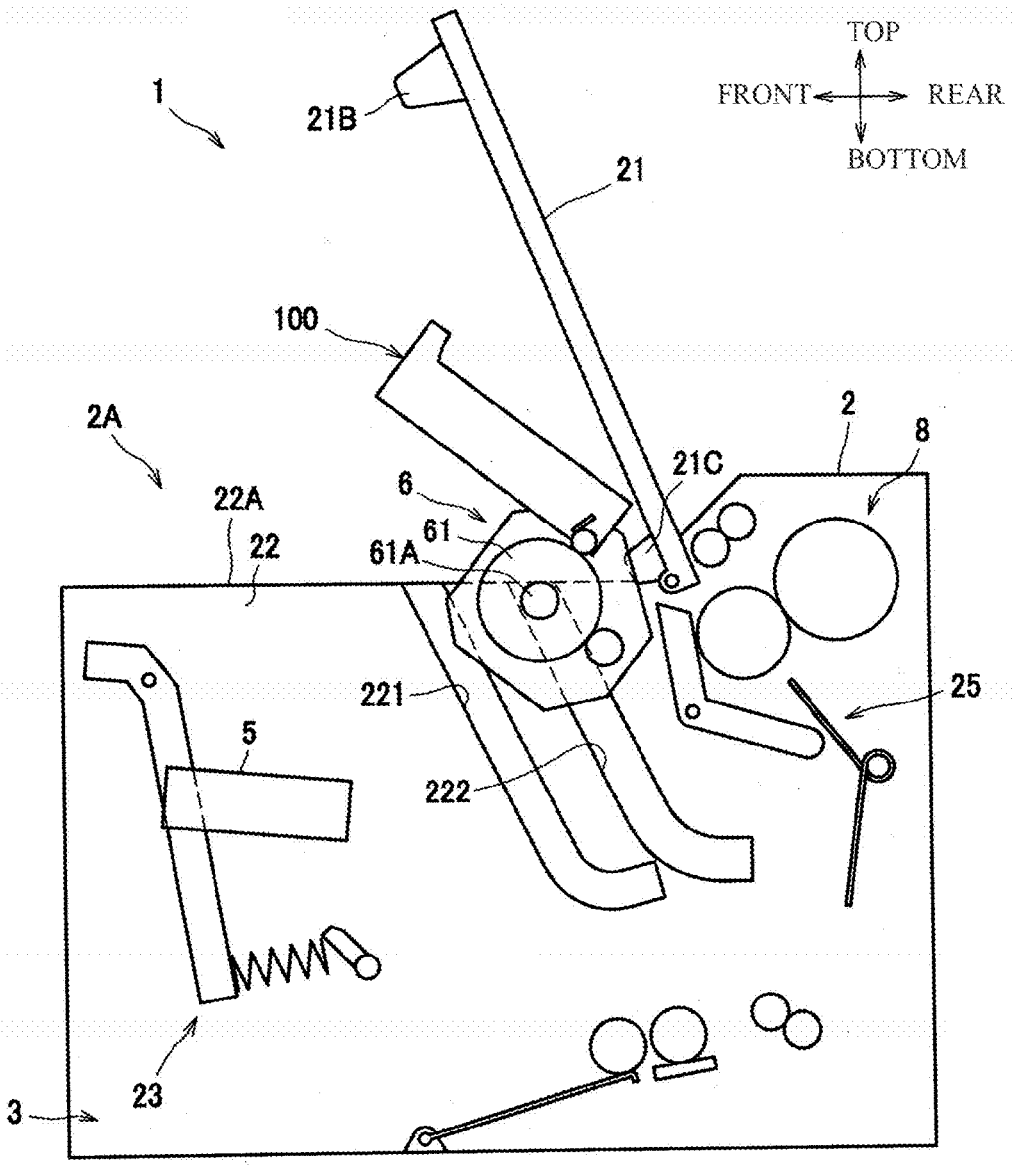
FIG. 7 illustrates how the photosensitive member cartridge is guided by a photosensitive member guide.

The photosensitive member cartridge 6 is arranged at a rear position and at a central position in the top-bottom direction inside the apparatus body 2, and is configured so as to be detachable from the apparatus body 2 through the opening 2A (see FIG. 7). The photosensitive member cartridge 6 is equipped with a frame 69, the photosensitive drum 61 which is attached to the frame 69, a transfer roller 62, a charger (not shown), and the waste toner container 100 (described later) which is an example of a waste developer container.

The developing cartridge 7 is arranged in front of the photosensitive member cartridge 6 and is configured so as to be detachable from the apparatus body 2 through the opening 2A. The developing cartridge 7 is equipped with a development roller 71 which is an example of a developer supporting body, a supply roller 72, and a toner containing unit 73.

The fixing unit 8 is arranged above the photosensitive member cartridge 6 and is equipped with a heating roller 81 and a pressing roller 82.

In the image forming unit 4, the surface of the photosensitive drum 61 that is charged uniformly by the charger is exposed being scanned at a high speed with laser light emitted from the exposing unit 5, whereby an electrostatic latent image is formed on the photosensitive drum 61. Toner is supplied from inside the toner containing unit 73 to the development roller 71 by the supply roller 72 and then held on the surface of the development roller 71.

The toner that is held on the surface of the development roller 71 is supplied to the electrostatic latent image formed on the photosensitive drum 61, whereby the electrostatic latent image is visualized, that is, a toner image is formed on the photosensitive drum 61.

Subsequently, a sheet P that is supplied from the feed unit 3 is conveyed between the photosensitive drum 61 and the transfer roller 62, whereby the toner image formed on the photosensitive drum 61 is transferred to the sheet P. After passing the photosensitive drum 61, the sheet P is conveyed between the heating roller 81 and the pressing roller 82, whereby the toner image that has been transferred to the sheet P is fixed thermally.

The discharge unit 9, which serves to convey a sheet P on which an image is formed as a result of thermal fixing of a toner image to outside the apparatus body 2, is equipped with an discharge roller pair 91 and an discharge path 92 which is an example of a second conveying path. The discharge path 92 is a path for conveying a sheet P that is conveyed from the fixing unit 8 to the top cover 21, which is part of a sheet discharging tray, while curving the sheet P forward.

In the discharge unit 9, the sheet P that has passed the image forming unit 4 (photosensitive drum 61) is conveyed toward the discharge roller pair 91 while being curved toward the front side of the apparatus body 2 (i.e., toward a second side (the other side) in the horizontal direction), and is discharged to outside the apparatus body 2 and placed on the top cover 21.

<Structures Around Photosensitive Member Cartridge and Developing Cartridge>

Next, structures around the photosensitive member cartridge 6 and the developing cartridge 7 will be described. The apparatus body 2 has side frames 22 which are arranged on the left side and the right side of the photosensitive member cartridge 6 and the developing cartridge 7. Each side frame 22 is formed with a development guide 221 which is an example of a first guide and a photosensitive member guide 222 which is an example of a second guide. Since the side frames 22 are right-left symmetrical with each other, only the left-side side frame 22 will be described below.

The development guide 221 is a groove for guiding a development roller shaft 71A (more specifically, a shaft support portion that supports the development roller shaft 71A rotatably) which is an example of a first guided portion, and is formed so as to have such a size as to be fitted with the development roller shaft 71A. In the embodiment, the development roller shaft 71A projects from the developing cartridge 7 outward in the left-right direction so as to be able to engage with the development guide 221.

The development guide 221 has a first development guide portion 221A, a second development guide portion 221B which is an example of a pressing guide portion, and a third development guide portion 221C. The first development guide portion 221A extends from the top edge 22A of the side frame 22 obliquely downward and rearward. The third development guide portion 221C is curved rearward from the bottom end of the first development guide portion 221A.

The second development guide portion 221B extends obliquely rearward and upward from the rear end of the third development guide portion 221C. More specifically, the second development guide portion 221B extends in a pressing direction in which a first pressing mechanism 23 which is attached to the side frame 22 presses the development roller 71 against the photosensitive drum 61 (see FIG. 5A). With this structure, pressing force of the development roller 71 can easily be transmitted to the photosensitive drum 61.

Around the rear end 221D of the second development guide portion 221B (see FIG. 5A), the development roller 71 is rotatable about a second axis X2 which is parallel with a first axis X1 of the photosensitive drum 61. In a state that the developing cartridge 7 is attached to the apparatus body 2, a preset interval is formed between the development roller shaft 71A of the development roller 71 and the rear end 221D of the second development guide portion 221B. As a result, the development roller 71 can be pressed toward the photosensitive drum 61 with a proper pressing force.

With the above-described development guide 221, as shown in FIG. 2, the developing cartridge 7 is attached to and detached from the apparatus body 2 through the opening 1A as a result of being moved generally in the top-bottom direction (perpendicularly to the second axis X2) while being kept within an installment passage Z.

The first pressing mechanism 23 is a mechanism for pushing the developing cartridge 7 toward the photosensitive drum 61, and is equipped with a pressing member 231, a developing cartridge swinging member 232, and a compression spring 233.

The pressing member 231 is configured so as to push, from the front side, a pressed portion 74 that projects obliquely forward and downward from a front end portion of the developing cartridge 7. The pressing member 231 has a pressing portion 231B which extends obliquely upward and forward from a rotation shaft 231A and can come into contact with the pressed portion 74. The pressing portion 231B is rotatable relative to the side frame 22 about the rotation shaft 231A which is supported by the side frame 22.

Figure 5A:
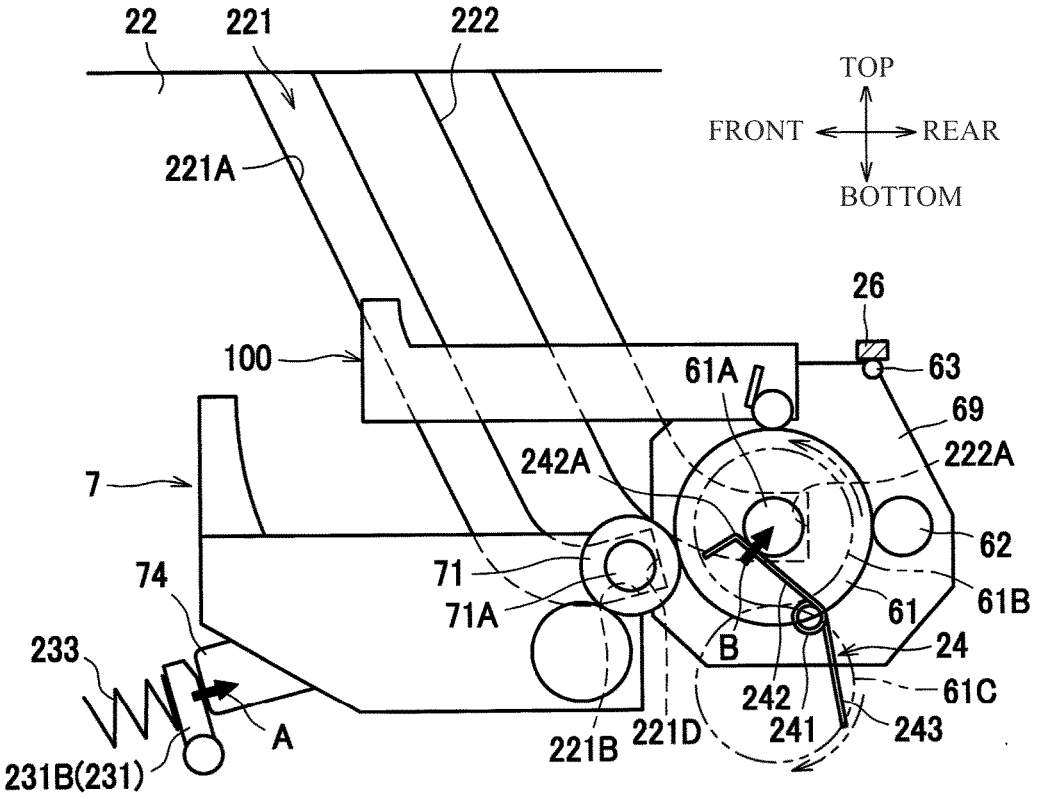

The pressing portion 231B is configured so as to rotate between a contact position (shown in FIG. 1) where it is in contact with the pressed portion 74 and an escape position (shown in FIG. 2) where it separated from the pressed portion 74. When located at the contact position, as shown in FIG. 5A the pressing portion 231B pushes the pressed portion 74 in a pressing direction A (i.e., obliquely rearward and upward).

The developing cartridge swinging member 232 is configured so as to be rotatable relative to the side frame 22 about a rotation shaft 232A which is supported by the side frame 22, and is arranged in front of the developing cartridge 7. The developing cartridge swinging member 232 has a first development arm 232B which extends forward from the rotation shaft 232A in a state that the top cover 21 is closed and a second development arm 232C which extends obliquely downward and rearward from the rotation shaft 232A in the same state.

In a state that the top cover 21 is closed, the first development arm 232B is located at a position as to be opposed to and be in contact with the first projection 21B of the top cover 21. Since the first development arm 232B is in contact with the first projection 21B, the developing cartridge swinging member 232 is prevented from rotating clockwise (as viewed in FIG. 1). The developing cartridge swinging member 232 is configured so as to rotate between a first restriction position (shown in FIG. 1) where the first development arm 232B is in contact with the first projection 21B and a first release position (shown in FIG. 2) where the contact between the first development arm 232B and the first projection 21B is released and the developing cartridge swinging member 232 is rotated clockwise (as viewed in FIG. 2) from the first restriction position.

The second development arm 232C extends so that its bottom end portion reaches to such a position as to be opposed to the pressed portion 74 of the developing cartridge 7. The bottom end portion of the second development arm 232C is closest to the pressed portion 74 when the developing cartridge swinging member 232 is located at the first restriction position. The second development arm 232C serves to move the pressing portion 231B via the compression spring 233 so that the pressing portion 231B comes to be located at the contact position (the developing cartridge swinging member 232 reaches the first restriction position) or the escape position (the developing cartridge swinging member 232 reaches the first release position).

The compression spring 233 is arranged between the pressing portion 231B and the second development arm 232C. The rear end 233A of the compression spring 233 can come into contact with the front surface of a tip portion of the pressing portion 231B and its front end 233B is fixed to the rear surface of a bottom end portion of the second development arm 232C. When the developing cartridge swinging member 232 is located at the second restriction position, the compression spring 233 urges the pressing portion 231B toward the pressed portion 74.

When the top cover 21 is closed, as shown in FIG. 1 its first projection 21B comes into contact with the first development arm 232B of the developing cartridge swinging member 232 and the second development arm 232C is thereby moved to the first restriction position, whereby the pressing portion 231B is rotated to the contact position by the compression spring 233. The pressing portion 231B is urged toward the developing cartridge 7 by the compression spring 233. In this manner, the development roller 71 of the developing cartridge 7 is pressed toward the photosensitive drum 61 in link with an operation of closing the top cover 21.

On the other hand, when the top cover 21 is opened, as shown in FIG. 2 its first projection 21B is separated from the first development arm 232B and the second development arm 232C is thereby moved to the first release position by action of the compression spring 233, whereby the compression spring 233 is separated from the pressing portion 231B and the pressing portion 231B moves to the escape position because of gravity. In this manner, the pressing of the development roller 71 of the developing cartridge 7 against the photosensitive drum 61 is released in link with an operation of opening the top cover 21.

Figure 3:
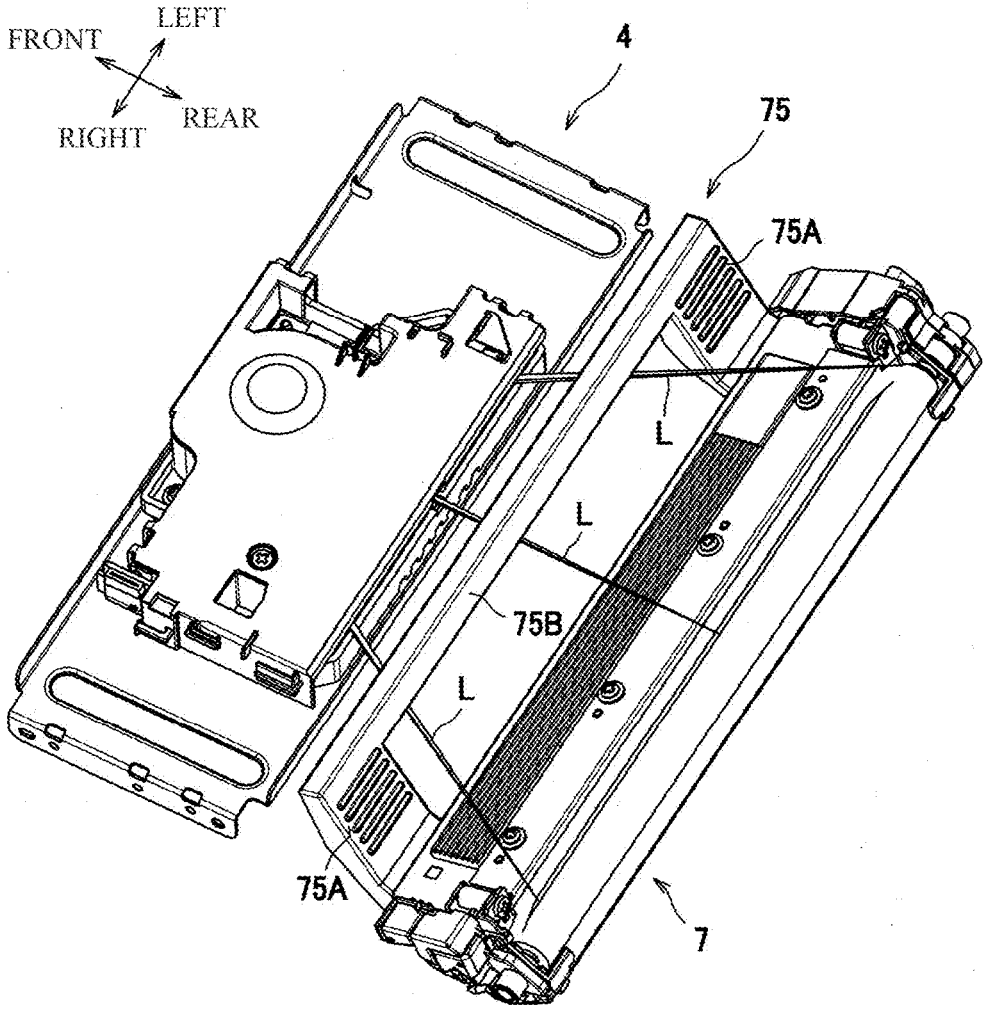
FIG. 3 is a perspective view, as viewed from the rear side, of a combination of a developing cartridge and an exposing unit.

As shown in FIG. 3, a cartridge grip 75 to be gripped by a user is attached to the developing cartridge 7. The cartridge grip 75 has a pair of arms 75A which extend upward from a front-left end portion and a front-right end portion of the developing cartridge 7 and a grip portion 75B which connects top end portions of the pair of arms 75A. The cartridge grip 75 may be either integral with or separate from the developing cartridge 7.

The pair of arms 75A are located outside of, that is, on the left side and right side of, the range (in the left-right direction (the direction of the second axis X2)) of optical paths L of laser light that is emitted from the exposing unit 5 in a state that the developing cartridge 7 is attached to the apparatus body 2. The grip portion 75B is located over the range of optical paths L. Arranged in this manner, the cartridge grip 75 is prevented from interfering with the optical paths L and makes it possible to remove the developing cartridge 7 from above with high operability.

As shown in FIG. 1, the photosensitive member guide 222 is a groove for guiding a photosensitive drum shaft 61A (more specifically, a shaft support portion that supports the photosensitive drum shaft 61A) which is an example of a second guided portion, and is formed so as to have such a size as to be fitted with the photosensitive drum shaft 61A. In the embodiment, the photosensitive drum shaft 61A projects from the photosensitive member cartridge 6 outward in the left-right direction so as to be able to engage with the photoreceptor guide 222.

The photosensitive member guide 222 extends from a position, in the rear of the position from which the development guide 221 extends, of the top edge 22A of the side frame 22 obliquely downward and rearward, and is then curved so as to extend rearward.

As shown in FIG. 7, the photosensitive member guide 222 allows the photosensitive member cartridge 6 to be detachable from the apparatus body 2 through the opening 2A generally in the top-bottom direction (perpendicularly to the first axis X1). As shown in FIG. 4B, a rear end portion of the photosensitive member guide 222 serves as a positioning portion 223 for the photosensitive drum shaft 61A when the photosensitive drum 61 is attached.

The positioning portion 223 has a first wall surface 222A which is an example of a positioning surface and is a rear end surface of the photosensitive member guide 222, a second wall surface 222B which extends forward from the top end of the first wall surface 222A, and a third wall surface 222C which extends forward from the bottom end of the first wall surface 222A.

Urged by a first twisted coil spring 24 (described later) in an urging direction B, a rear portion and a top portion of the circumferential surface of the photosensitive drum shaft 61A is in contact with the first wall surface 222A of the photosensitive member guide 222 and its second wall surface 222B, respectively. Urged by the first twisted coil spring 24, the photosensitive drum shaft 61A is arranged so as to be spaced from the third wall surface 222C by a preset interval G in the top-bottom direction. The photosensitive drum 61 is configured to be rotatable about the first axis X1 at a position that the photosensitive drum shaft 61A is in contact with the first wall surface 222A and the second wall surface 222B.

The first twisted coil spring 24 (first arm 242) is in contact with the photosensitive drum shaft 61A on a line Y that connects the first axis X1 and a connection portion 222D of the first wall surface 222A and the second wall surface 222B. The urging direction B of the first twisted coil spring 24 coincides with the extending direction of the line Y.

The photosensitive member cartridge 6 is configured to be rotatable relative to the side frame 22 about the photosensitive drum shaft 61A between the position shown in FIG. 1 and the position shown in FIG. 2 when it is located at a position that the photosensitive drum shaft 61A is in contact with the first wall surface 222A and the second wall surface 222B.

Figure 4A:
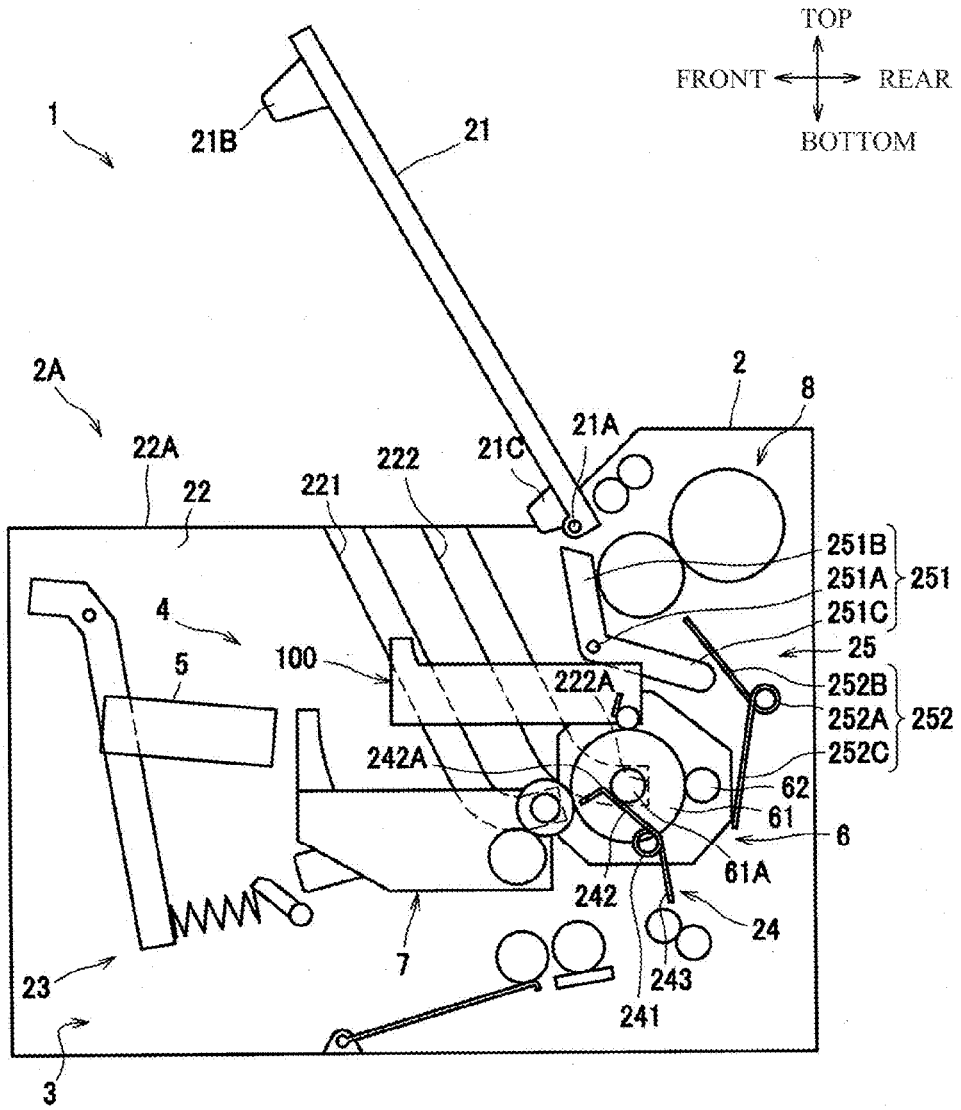
Figure 4B:
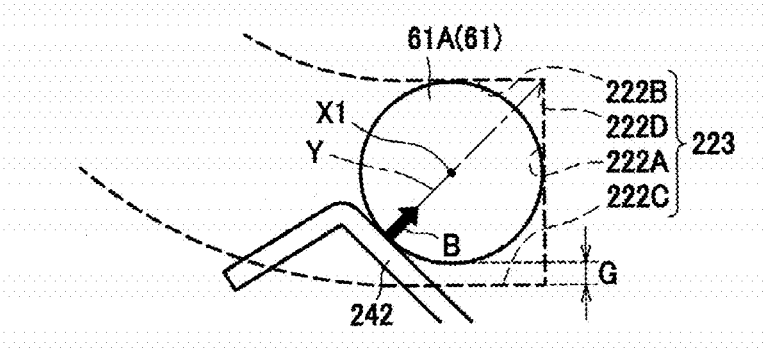

As shown in FIG. 4A, the first twisted coil spring 24 which is an example of an urging member, a second pressing mechanism 25 which is an example of a pressing mechanism, and a restriction portion 26 (see FIG. 5A) are arranged around the photosensitive member cartridge 6.

The first twisted coil spring 24 is a member for urging the photosensitive drum shaft 61A toward the first wall surface 222A and the second wall surface 222B, and is arranged under the photosensitive drum shaft 61A of the photosensitive member cartridge 6 installed. The first twisted coil spring 24 has a coil portion 241 which is supported by the side frame 222, a first arm 242 which extends obliquely forward/upward from the coil portion 241, and a second arm 243 which extends obliquely downward and rearward from the coil portion 241. The second arm 243 is fixed to the side frame 22.

A tip portion of the first arm 242 has a bent portion 242A which is bent obliquely forward and downward. As shown in FIG. 5A, projecting above the bottom surface of the photosensitive member guide 222, the bent portion 242A is lowered as the photosensitive drum shaft 61A passes it and returns to the original position after passage of the photosensitive drum shaft 61A. The first arm 242 urges the photosensitive drum shaft 61A obliquely rearward/upward (i.e., in the urging direction B) to bring it into contact with the first wall surface 222A and the second wall surface 222B. As a result, the photosensitive drum 61 can be positioned at a position that the photosensitive drum shaft 61A is in contact with the first wall surface 222A and the second wall surface 222B.

The urging direction B of the first arm 242 has a component in the same direction as the above-described pressing direction A in which the development roller 71 presses the photosensitive drum 61. Therefore, part of the pressing force of the compression spring 233 contributes to the pressing force for positioning of the photosensitive drum 61. As a result, the urging force of the first twisted coil spring 24 for positioning of the photosensitive drum 61 can be reduced accordingly.

As shown in FIGS. 1 and 4A, the second pressing mechanism 25 is a mechanism for pressing the transfer roller 62 and is equipped with a transfer roller swinging member 251 and a second twisted coil spring 252. In the embodiment, the transfer roller 62 is attached to the frame 69 so as to be able to move in the front-rear direction between a position where it is in contact with the photosensitive drum 61 and a position where it is separated from the photosensitive drum 61.

The transfer roller swinging member 251 is configured so as to be able to rotate relative to the side frame 22 about a rotation shaft 251A which is supported by the side frame 22. The transfer roller swinging member 251 has a first transfer arm 251B which extends upward and forward from the rotation shaft 251A in a state that the top cover 21 is closed and a second transfer arm 251C which extends approximately rearward from the rotation shaft 251A in the same state.

In a state that the top cover 21 is closed, the first transfer arm 251B is located at a position that it is opposed to the second projection 21C of the top cover 21 and its tip surface is in contact with the second projection 21C. Since the first transfer arm 251B is in contact with the second projection 21C, the transfer roller swinging member 251 is prevented from rotating clockwise (as viewed in FIG. 1). The transfer roller swinging member 251 is configured so as to rotate between a second restriction position (shown in FIG. 1) where the first transfer arm 251B is in contact with the second projection 21C and a second release position (shown in FIG. 4A) where the contact between the first transfer arm 251B and the second projection 21C is released and the transfer roller swinging member 251 has been rotated clockwise (as viewed in FIG. 4A) from the second restriction position.

When the transfer roller swinging member 251 is located at the second restriction position, the rear end of the second transfer arm 251C is in contact with the second twisted coil spring 252 (upper arm 252B) from the front side. When the transfer roller swinging member 251 is located at the second release position, the rear end of the second transfer arm 251C is separated from the second twisted coil spring 252 obliquely downward and forward.

The second twisted coil spring 252 has a coil portion 252A which is supported by the side frame 22, an upper arm 252B which extends obliquely upward and forward from the coil portion 252A, and a lower arm 252C which extends obliquely downward and forward from the coil portion 252A.

The upper arm 252B is arranged at a position as to be opposed to the rear end of the second transfer arm 251C of the transfer roller swinging member 251. A tip portion of the lower arm 252C is arranged in the rear of the transfer roller 62.

When the top cover 21 is closed, its second projection 21C comes into contact with the first transfer arm 251B of the transfer roller swinging member 251 and the second transfer arm 251C is thereby moved to the second restriction position and pushes the upper arm 252B of the second twisted coil spring 252 rearward. As a result, the lower arm 252C is rotated about the center of the coil portion 252A to move forward and pushes the transfer roller 62 forward so that it is pressed toward the photosensitive drum 61. During that course, the second twisted coil spring 252 is deformed, as a result of which the lower arm 252C urges the transfer roller 62. In this manner, the transfer roller 62 is urge toward the photosensitive drum 61 in link with an operation of closing the top cover 21.

When the top cover 21 is opened, its second projection 21C is separated from the first transfer arm 251B and the second development arm 251C is thereby moved to the second release position by the urging force of the second compression spring 252 and separated from the upper arm 252B. The second twisted coil spring 252 restores its original shape. In this manner, the pressing of the transfer roller 62 against the photosensitive drum 61 is released in link with an operation of opening the top cover 21.

As shown in FIG. 5A, the restriction portion 26 serves to prevent rotation of the frame 69 in the rotation direction of the photosensitive drum 61 in a state that the waste toner container 100 is located at a first position (described later). The restriction portion 26 projects from the side frame inward in the left-right direction and is arranged at a position as to be opposed to the top of the rear end of the photosensitive member cartridge 6 that is attached to the apparatus body 2.

A shaft 63 projects outward in the left-right direction from the frame 69 of the photosensitive member cartridge 6 at a position as to be able to come into contact with the restriction portion 26 from below. Incidentally, if force produced by movement of a sheet P or rotation of a drum gear 61B which is connected to the photosensitive drum 61 or an intermediate gear 61C which is in mesh with the drum gear 61B were transmitted to the frame 69, the frame 69 would likely rotate in the rotation direction (counterclockwise as viewed in FIG. 5A) of the photosensitive drum 61. In contrast, in the embodiment, since the restriction portion 26 comes into contact with the shaft 63 from above, rotation of the frame 69 is prevented and hence resulting influence on image formation is reduced.

Figure 5B:
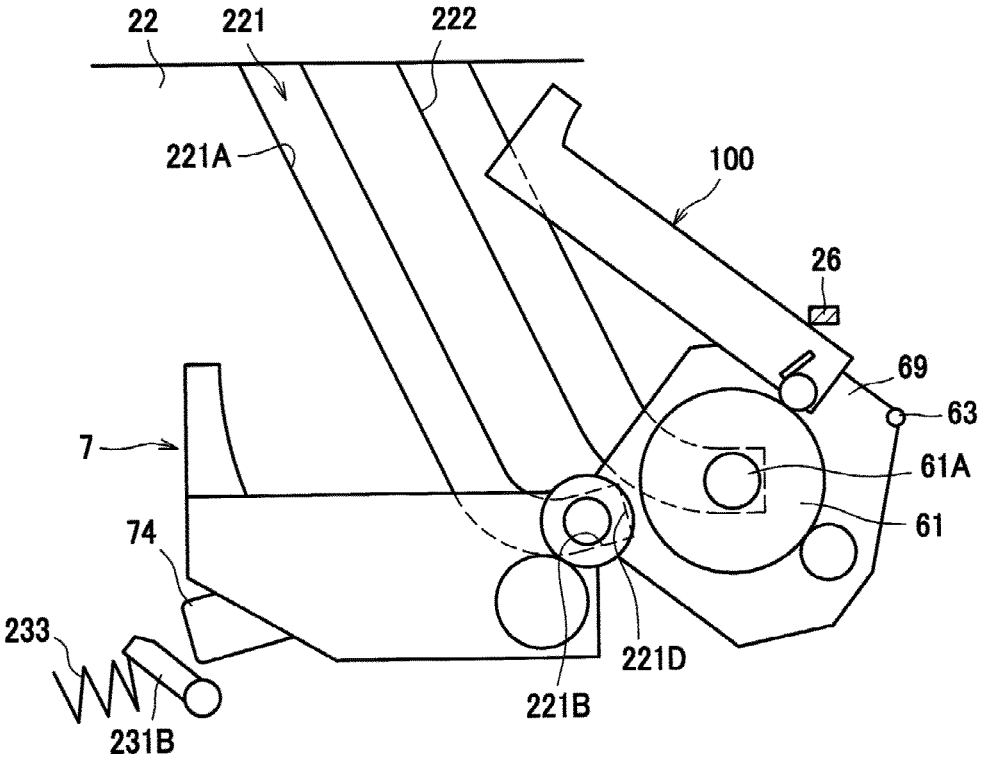

As shown in FIG. 5B, when the frame 69 is rotated clockwise, the shaft 63 is separated from the restriction portion 26. That is, the frame 69 is configured to be rotatable together with the waste toner container 100 as the latter swings from the first position to a second position.

<Waste Toner Container>

Next, the waste toner container 100 will be described. As shown in FIG. 1, the waste toner container 100 is a container for containing toner that is collected from the photosensitive drum 61 and is arranged above the photosensitive drum 61. The waste toner container 100 is provided with a cleaning roller 110 which is an example of a cleaning member and a cleaning blade 120 which is in contact with the cleaning roller 110.

The cleaning roller 110 is configured to be in contact with the surface of the photosensitive drum 61, and to collect toner from the surface of the photosensitive drum 61. Part of the circumferential surface of the cleaning roller 110 is exposed from the waste toner container 100.

The cleaning blade 120 is configured to be in contact with the circumferential surface of the cleaning roller 110 inside the waste toner container 100, and to scrape off collected toner from the surface of the cleaning roller 110. Toner that is scraped off the cleaning roller 110 is stored in the waste toner container 100.

Figure 6A:
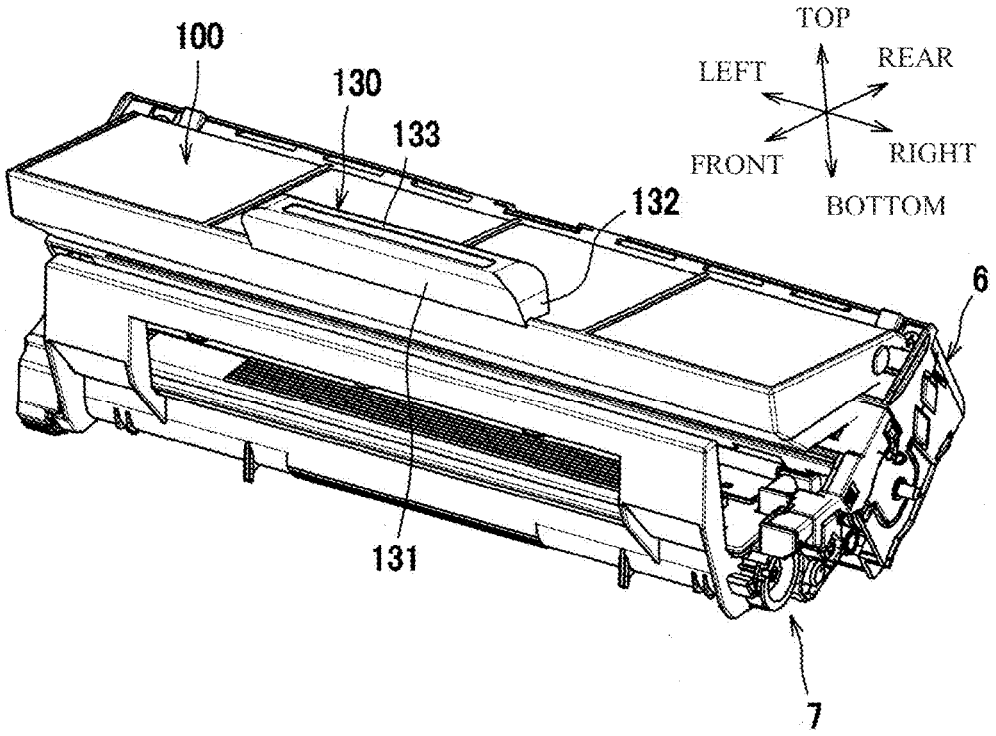
FIGS. 6A and 6B are perspective views, as viewed from the front side and the rear side, respectively, of a combination of the photosensitive member cartridge and the developing cartridge.
Figure 6B:
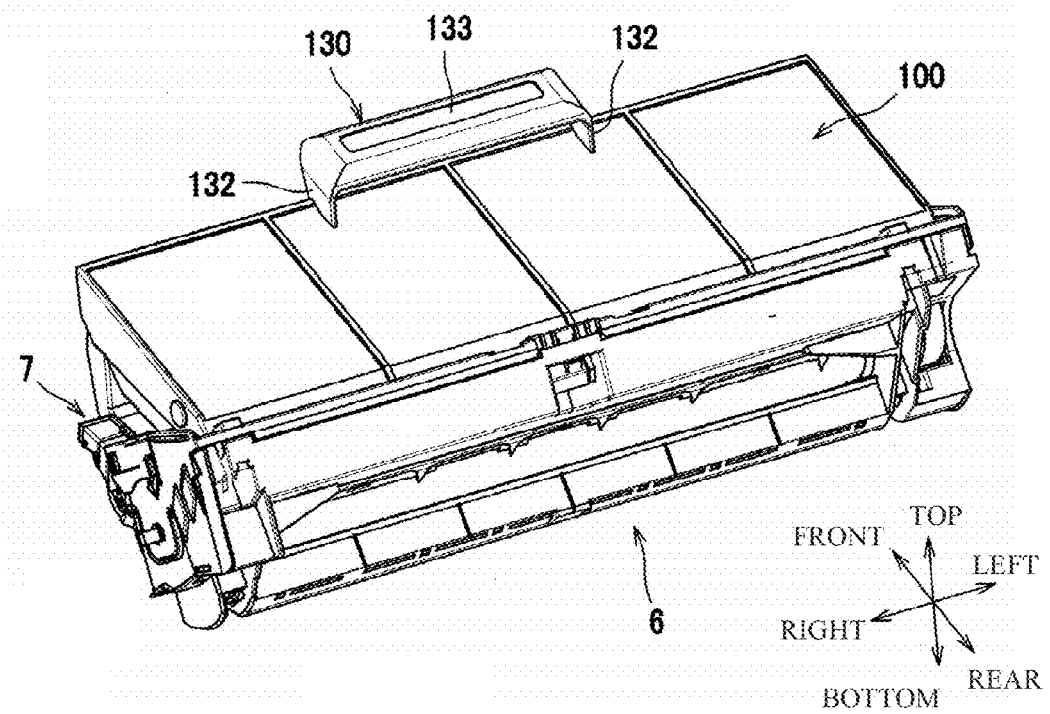

As shown in FIGS. 6A and 6B, the waste toner container 100 is provided with a cartridge grip 130 to be gripped by a user. The cartridge grip 130 projects from the front edge of the top surface of the waste toner container 100, and has a front wall 131, side walls 132 which project rearward from the left edge and the right edge of the front wall 131, respectively, and a top wall 133 which projects rearward from the top edge of the front wall 131. The cartridge grip 130 may be either integral with or separate from the waste toner container 100.

As shown in FIG. 2, the waste toner container 100 is configured to be integral with the photosensitive member cartridge 6. As the photosensitive member cartridge 6 is swung, the waste toner container 100 is swung about the first axis X1 which is parallel with the second axis X2 between the first position where the waste toner container 100 overlaps with the installment passage Z that the developing cartridge 7 forms when it is attached to or detached from the apparatus body 2 and the second position where the waste toner container 100 is out of the installment passage Z.

In the following, a description will be made of workings and advantages of the laser printer 1 having the above configuration.

When the developing cartridge 7 is replaced, the top cover 21 is opened and the developing cartridge 7 in use is detached and a new one is attached through the opening 2A. If in this state the waste toner container 100 is located at the first position, the waste toner container 100 would interfere with the developing cartridge 7 in attaching or detaching the latter to cause difficulty doing so.

In contrast, in the embodiment, in attaching or detaching the developing cartridge 7, it is possible to cause the waste toner container 100 to escape from the installment passage Z of the developing cartridge 7 by gripping the top wall 133 of the cartridge grip 130 of the waste toner container 100 and moving it to the second position. Thus, the developing cartridge 7 can be attached or detached easily.

Assume an example configuration in which the waste toner container is equipped with a cleaning blade and the frame of the photosensitive member cartridge is provided with a cleaning roller. If the waste toner container is swung relative to the frame of the photosensitive member cartridge about the cleaning roller, the position of contact between the cleaning blade and the cleaning roller would vary to render the cleaning roller to prone to damage.

In contrast, in the embodiment, since the photosensitive member cartridge 6, the waste toner container 100, the cleaning roller 110, and the cleaning blade 120 are swung together, it is possible to suppress damaging of the cleaning roller 110 by the cleaning blade 120.

Since the pressing by the first pressing mechanism 23 is released merely by opening the top cover 21, the developing cartridge 7 can be attached and detached easily.

If an pressing mechanism for pressing the transfer roller 62 against the photosensitive drum 61 is configured in such a manner that the pressing of the transfer roller 62 against the photosensitive drum 61 is not released, it would be necessary to, for example, swing the photosensitive member cartridge 6 against the pressing by the pressing mechanism and hence it would be difficult to swing the photosensitive member cartridge 6. In contrast, in the embodiment, since the pressing by the second pressing mechanism 25 can be released easily by merely opening the top cover 21. Thus, the photosensitive member cartridge 6 can be swung easily.

Furthermore, since the cartridge grip 130 allows a user to swing the waste toner container 100 easily, the cartridge grip 130 enhances the operability of the waste toner container 100.

Still further, in the configuration that as in the embodiment the photosensitive drum 61 and the waste toner container 100 are arranged in a path that connects the sheet feed tray 31 and the top cover 21 on the rear side, it is unavoidable to arrange the waste toner container 100 above the developing cartridge 7. In this configuration, in the case where the developing cartridge 7 is attached and detached from above, the waste toner container 100 tends to overlap with the installment passage Z unless a proper measure is taken. In contrast, in the embodiment, the developing cartridge 7 can be attached and detached easily by swinging the waste toner container 100.

[Second Embodiment]

Next, a second embodiment of the present disclosure will be described. In the second embodiment, components and elements having the same or similar ones in the first embodiment will be given the same reference symbols as the latter and descriptions therefor will be omitted.

Figure 8A:
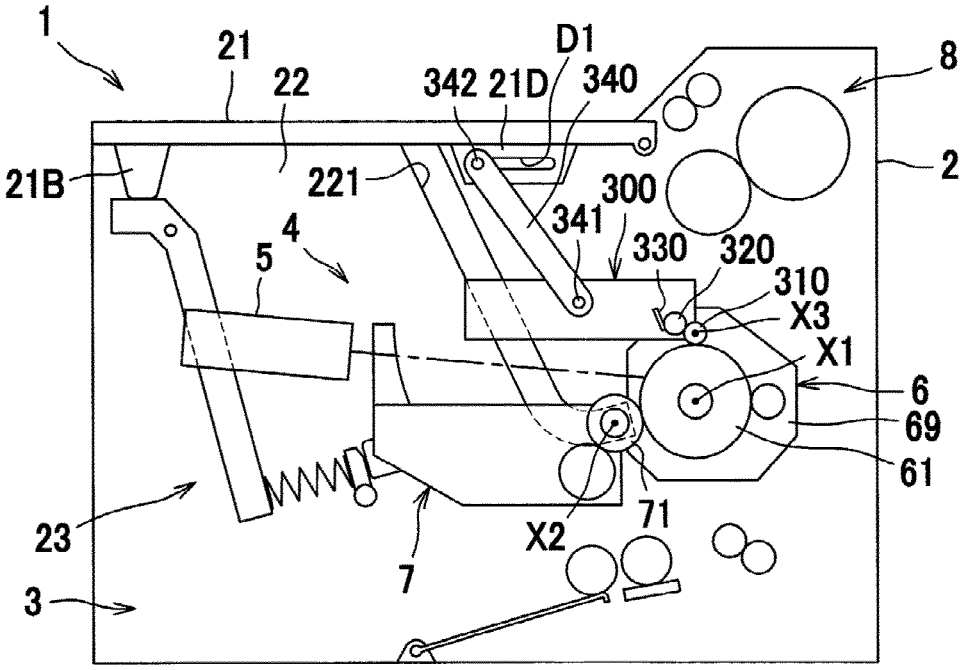
FIG. 8A shows a general configuration of a laser printer according to a second embodiment of the present disclosure.

In this embodiment, as shown in FIG. 8A, the photosensitive member cartridge 6 is configured in such a manner that the frame 69 which supports the photosensitive drum 61 cannot be swung relative to the apparatus body 2. The frame 69 may either be fixed to the apparatus body 2 or be detachable from the apparatus body 2.

A waste toner container 300 is equipped with a first cleaning roller 310 which is in contact with the photosensitive drum 61, a second cleaning roller 320 which is in contact with the first cleaning roller 310, and a scraping member 330 which is in contact with the second cleaning roller 320.

The first cleaning roller 310 is a roller for collecting toner from the surface of the photosensitive drum 61, and part of its circumferential surface is exposed from the waste toner container 300. The second cleaning roller 320 is a roller for collecting toner that is collected by the first cleaning roller 310, and is in contact with the first cleaning roller 310 inside the waste toner container 300. The scraping member 330 is configured so as to scrape off toner from the surface of the second cleaning roller 320, and is in contact with the second cleaning roller 320 inside the waste toner container 300.

The waste toner container 300 is configured so as to be able to swing relative to the frame 69 about an axis X3 of the first cleaning roller 310 which is parallel with the first axis X1 and the second axis X2. Since the waste toner container 300 is swung about the axis X3 of the first cleaning roller 310, the position of contact between the scraping member 330 and the second cleaning roller 320 does not vary, whereby damaging of the second cleaning roller 320 is suppressed. The waste toner container 300 is connected to the top cover 21 by a link member 340.

A bottom end portion 341 of the link member 340 is attached rotatably to the waste toner container 300, and its top portion 342 is attached rotatably to a third projection 21D which projects from the bottom surface of the top cover 21. The link member 340 and the third projection 21D are example components of a link mechanism. A long hole Dl for supporting the top end portion 342 of the link member 340 rotatably and movably in the front-rear direction is formed through the third projection 21D.

Figure 8B:
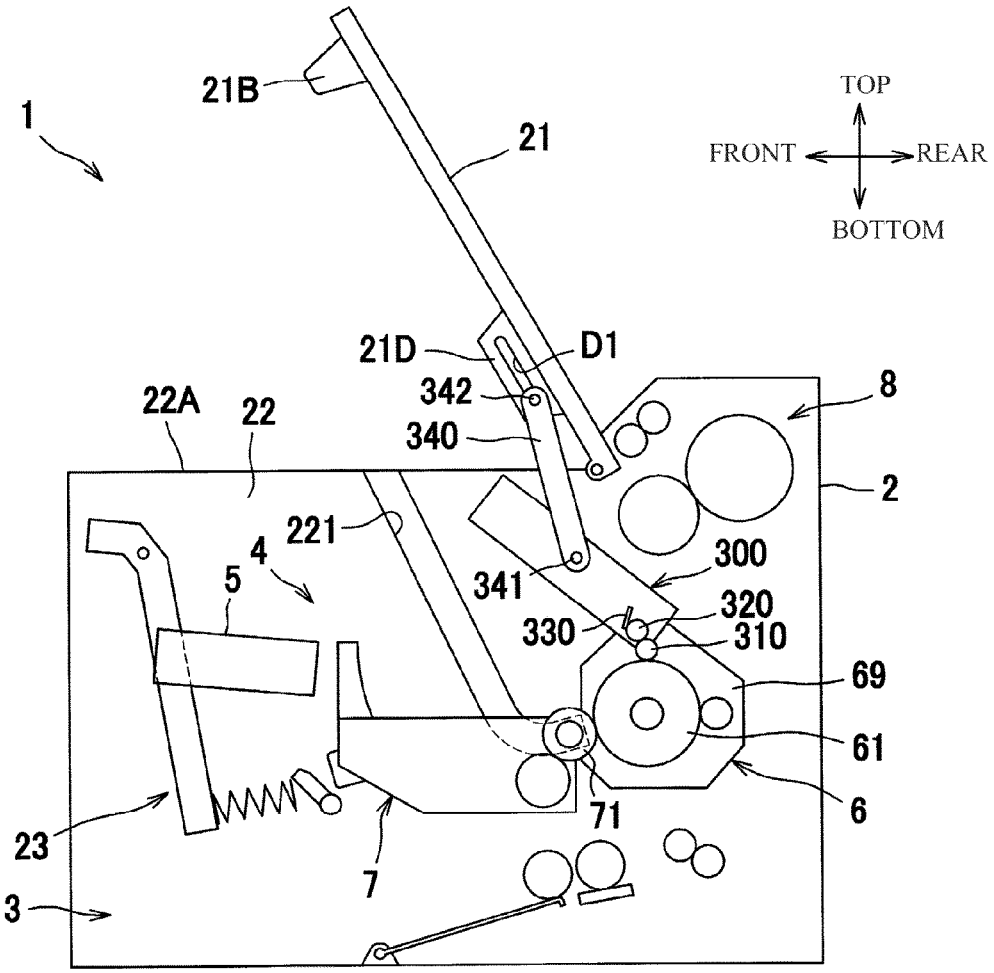
FIG. 8B shows a state that the top cover is opened.

As shown in FIG. 8B, when the top cover 21 is opened, the link member 240 is swung and its top end portion 342 comes into contact with the bottom edge (as viewed in FIG. 8B) of the long hole Dl, whereby the link member 340 lifts up the waste toner container 300. On the other hand, as shown in FIG. 8A, when the top cover 21 is closed, the link member 240 is swung and its top end portion 342 comes into contact with the front edge and the top edge (as viewed in FIG. 8B) of the long hole Dl, whereby the link member 340 pushes down the waste toner container 300. In this manner, the waste toner container 300 is swung between the first position and the second position in link with an operation of opening or closing the top cover 21.

With the above-described configuration, since the waste toner container 300 is moved to the second position merely by opening the top cover 21, the developing cartridge 7 can be attached and detached easily.

[Third Embodiment]

Figure 9A:
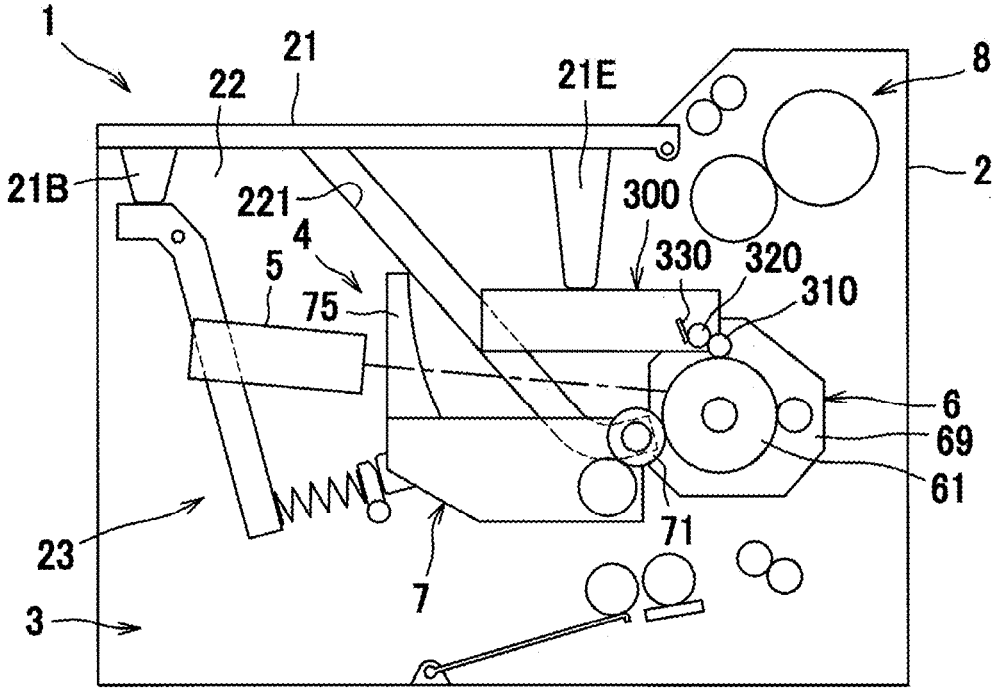
FIG. 9A shows a general configuration of a laser printer according to a third embodiment of the present disclosure.

Next, a third embodiment of the present disclosure will be described. As shown in FIG. 9A, in the third embodiment, the top cover 21 has, in place of the link member 340 and the third projection 21D employed in the second embodiment, a fourth projection 21E which can come into contact with the top surface of the waste toner container 300 that is located at the first position.

The cartridge grip 75 of the developing cartridge 7 projects from the top surface of the developing cartridge 7 to above the waste toner container 300 that is located at the first position. As a result, when the top cover 21 is opened, a user can visually recognize the cartridge grip 75 and hence grip it easily. In the other aspects, the third embodiment is the same in configuration as the second embodiment.

Figure 9B:
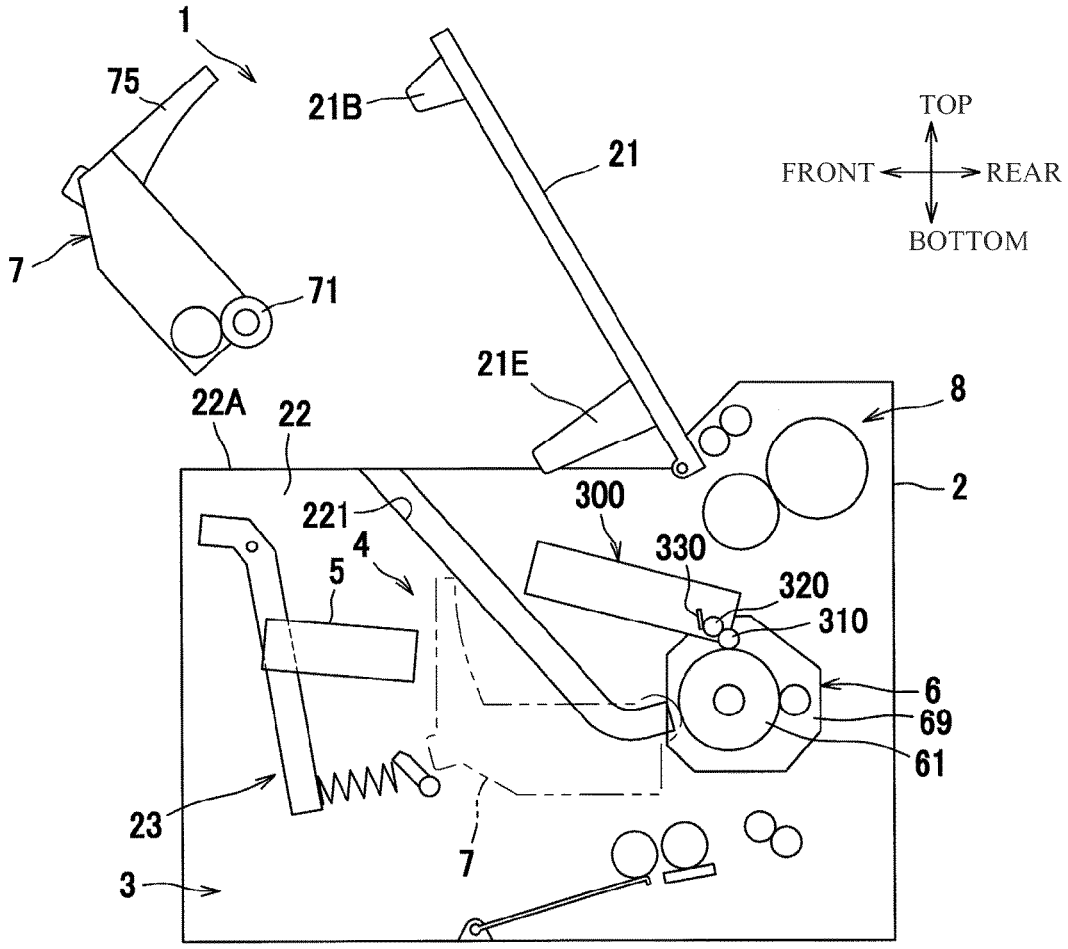
FIG. 9B shows a state that the top cover is opened.

As shown in FIG. 9B, when the top cover 21 is opened and the developing cartridge 7 is detached, the developing cartridge 7 hits the waste toner container 300 to push it up. That is, the waste toner container 300 is swung from the first position to the second position by an operation of detaching the developing cartridge 7.

With the above-described configuration, no link mechanism as employed in the second embodiment is necessary and hence the apparatus body 2 can be simplified in structure.

On the other hand, when the top cover 21 is closed after attachment of the developing cartridge 7, as shown in FIG.

9A the fourth projection 21E comes into contact with the waste toner container 300 and pushes it down. As a result, the waste toner container 300 returns from the second position to the first position.

[Fourth Embodiment]

Figure 10A:
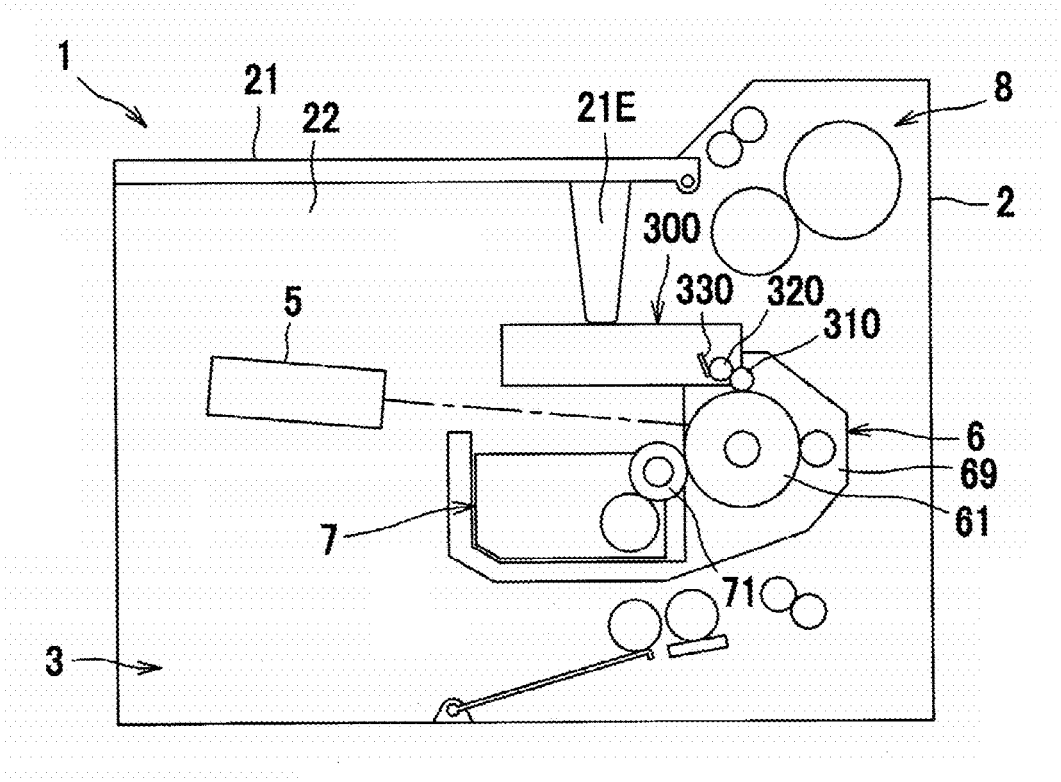
FIG. 10A shows a general configuration of a laser printer according to a fourth embodiment of the present disclosure.
Figure 10B:
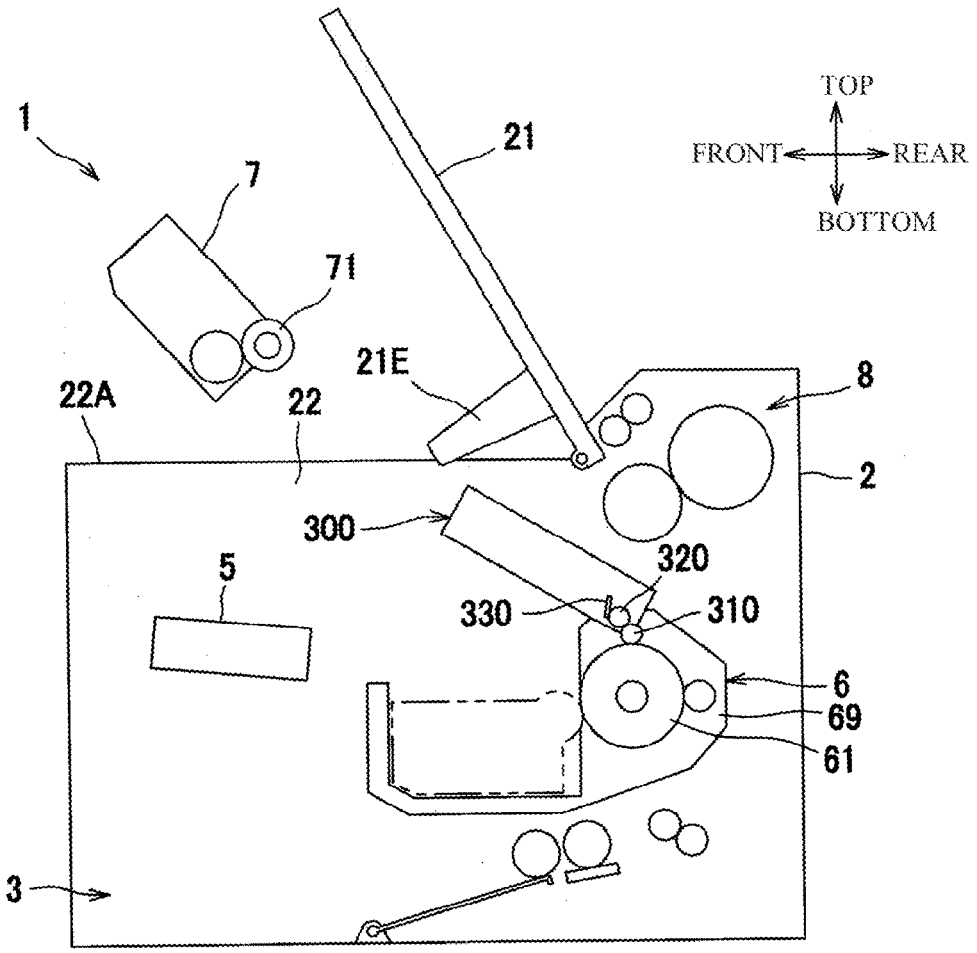
FIG. 10B shows a state that the top cover is opened.

Next, a fourth embodiment of the present disclosure will be described. Unlike each of the above embodiments, the fourth embodiment the first pressing mechanism does not employ the first pressing mechanism 23. In the other aspects, the fourth embodiment is the same in configuration as the third embodiment. In FIGS. 10A and 10B, the development guide 221 is omitted.

As shown in FIG. 10A, this embodiment employs the developing cartridge 7 that is supported by the frame 69. The photosensitive member cartridge 6 is detachable from the apparatus body 21, and the developing cartridge 7 is detachable from the frame 69.

In this configuration, to detach only the developing cartridge 7, as shown in FIG. 10B, as in the third embodiment, the waste toner container 300 is pushed up by the developing cartridge 7 and the developing cartridge 7 is then detached.

On the other hand, the photosensitive member cartridge 6 can be detached with the developing cartridge 7 kept attached to it. After detachment of the photosensitive member cartridge 6, the developing cartridge 7 can be detached from the photosensitive member cartridge 6 by swinging the waste toner container 300.

Although the embodiments of the present disclosure have been described above, the present disclosure is not limited to those embodiments. As for specific structures, various modifications can be made as appropriate without departing from the spirit and scope of the present disclosure.

Although in each embodiment the transfer roller 62 is provided in the photosensitive member cartridge 6, the transfer roller 62 may be attached to the apparatus body 2.

Although in each embodiment an operation for exerting pressure on the transfer roller 62 is in link with an operation of closing the top cover 21, these components may be configured not to be in link with each other.

Although in the first embodiment etc. a pressing operation of the pressing member 231 is in link with an operation of closing the top cover 21, these components may be configured not to be in link with each other.

Although in each embodiment the development roller shaft 71A is employed as an example of the first guided portion, the present disclosure is not limited to such a case; a shaft that projects outward in the left-right direction (second axis direction) from a frame of the developing cartridge 7 may be employed.

Although in each embodiment the photosensitive drum shaft 61A is employed as an example of the second guided portion, the present disclosure is not limited to such a case; a shaft that projects outward in the left-right direction (first axis direction) from the frame 69 of the photosensitive member cartridge 6 may be employed.

Although in each embodiment the urging direction B of the first twisted coil spring 24 has a component in the same direction as the pressing direction A in which to press the development roller 71, the urging direction B may not have such a component.

Although in each embodiment the development roller 71 is employed as an example of the developer supporting body, for example, a development sleeve having a magnet roller inside or a brush-like roller may be employed.

Although in the first embodiment etc. the urging direction B of the first twisted coil spring 24 has a component in the same direction as the pressing direction A of the pressing member 231, the urging direction B may coincide with the pressing direction A. In this case, it is preferable that the connection portion 222D of the first wall surface 222A and the second wall surface 222B (see FIG. 4B) be located on the line that connects the axis of the photosensitive drum shaft and the development roller shaft.

Although in each embodiment is directed to the monochrome laser printer 1 as an example image forming apparatus, for example, the concept of each embodiment may be applied to other image forming apparatus such as a copier.

What is claimed is:

1. An image forming apparatus comprising:

an apparatus body;

a developing cartridge comprising a development roller, wherein the apparatus body includes an opening for installing the developing cartridge;

a drum cartridge comprising:

a photosensitive drum;

a cleaner configured to collect developer remaining on the photosensitive drum; and a waste developer container configured to contain developer collected by the cleaner, a cover configured to be movable between a closed position at which covers the opening and an opening position at which uncovers the opening;

a link mechanism configured to link a movement of the cover with a movement of the waste developer container;

wherein the apparatus body includes a guide configured to guide the developing cartridge when the developing cartridge is installed into and removed from the apparatus body, and wherein the waste developer container is configured to be movable between a first position and a second position in a state where the drum cartridge is installed in the apparatus body, the waste developer container being located more away from the guide at the second position than at the first position.

2. The image forming apparatus according to claim 1 further comprising:

a photosensitive member cartridge including the photosensitive member, the waste developer container, and a support member that supports the photosensitive member, wherein the waste developer container is configured to be movable between the first position and the second position in a state where the photosensitive member cartridge is installed into the apparatus body.

3. The image forming apparatus according to claim 2, wherein the waste developer container is configured to rotatably move between the first position and the second position.

4. The image forming apparatus according to claim 2, wherein the waste developer container is configured to move between the first position and the second position together with the support member.

5. The image forming apparatus according to claim 2, wherein the apparatus body is provided with a restriction member that prevents the photosensitive drum from being rotated with respect to the support member in a state where the waste developer container is at the first position.

6. The image forming apparatus according to claim 2, wherein the waste developer container is configured to be movable from the first position to the second position in a state where the developing cartridge is installed into and removed from the apparatus body.

7. The image forming apparatus according to claim 2, wherein the waste developer container is provided with a container grip.

8. The image forming apparatus according to claim 2 further comprising:

an exposing unit configured to emit light toward the photosensitive member along an optical path, wherein the developing cartridge is provided with a cartridge grip that is located away from the optical path in a state where the developing cartridge is installed in the apparatus body.

9. The image forming apparatus according to claim 8, wherein the cartridge grip comprises a first cartridge grip and a second cartridge grip, and wherein the optical path is configured to pass through between the first cartridge grip and the second cartridge grip.

10. The image forming apparatus according to claim 9, wherein the first cartridge grip and the second cartridge grip are coupled with each other.

11. An image forming apparatus comprising:

an apparatus body;

a developing cartridge comprising a development roller; and a drum cartridge comprising:

a photosensitive drum;

a cleaner configured to collect developer remaining on the photosensitive drum; and a waste developer container configured to contain developer collected by the cleaner, an exposing unit configured to emit light toward the photosensitive drum along an optical path, wherein the developing cartridge is provided with first and second cartridge grips located away from the optical path in a state where the developing cartridge is installed in the apparatus body, the optical path configured to pass between the first cartridge grip and the second cartridge grip;

wherein the apparatus body comprises a guide configured to guide the developing cartridge, and wherein the waste developer container is configured to be movable between a first position and a second position in a state where the drum cartridge is installed in the apparatus body, the waste developer container being located more away from the guide at the second position than at the first position.

12. The image forming apparatus according to claim 11, wherein the apparatus body is configured to have an opening for installing the developing cartridge, and wherein the image forming apparatus further comprises:

a cover configured to be movable between a closed position at which covers the opening and an opened position at which uncovers the opening; and a link mechanism configured to link a movement of the cover with a movement of the waste developer container.

13. The image forming apparatus according to claim 12, wherein the waste developer container is configured to overlap with the guide when viewed from an axial direction of the development roller at the first position.

14. The image forming apparatus according to claim 13, wherein the waste developer container is configured to be located at a position away from the guide when viewed from the axial direction of the development roller at the second position.

15. The image forming apparatus according to claim 12, wherein the apparatus body is configured to have an opening for installing the developing cartridge, and wherein the first position is more distant from the opening than the second position.

16. The image forming apparatus according to claim 15, wherein the waste developer container is configured to rotatably move between the first position and the second position.

17. The image forming apparatus according to claim 12, wherein the first cartridge grip and the second cartridge grip are coupled with each other.

18. An image forming apparatus comprising:

an apparatus body having an installment passage through which the developing cartridge passes when the developing cartridge is installed into and removed from the apparatus body;

a developing cartridge comprising a development roller; and a drum cartridge comprising:

a photosensitive drum;

a cleaner configured to collect developer remaining on the photosensitive drum; and a waste developer container configured to contain developer collected by the cleaner, wherein the waste developer container is configured to be movable within the apparatus body between a first position at which at least a part of the waste developer container is located within the installment passage and a second position at which the waste developer container is located away from the installment passage.

19. An image forming apparatus, comprising:

a developing cartridge including a development roller;

a photosensitive drum;

an exposing unit configured to emit light toward the photosensitive drum along an optical path; and first and second cartridge grips attached to the developing cartridge, the first and second cartridge grips spaced apart from one another and positioned such that the optical path is configured to pass between the first cartridge grip and the second cartridge grip.

* * * * *